United States Patent [19]

Pohl

[11] Patent Number: 4,655,793

[45] Date of Patent: Apr. 7, 1987

[54] METHOD FOR OPERATING A COAL GASIFIER

[75] Inventor: Hans C. Pohl, Witten, Fed. Rep. of Germany

[73] Assignee: Krupp Koppers GmbH, Essen, Fed. Rep. of Germany

[21] Appl. No.: 735,552

[22] Filed: May 17, 1985

[30] Foreign Application Priority Data

Aug. 25, 1984 [DE] Fed. Rep. of Germany ..... 3431392

[51] Int. Cl.[4] ..... C10J 3/72; C10J 3/80

[52] U.S. Cl. ..... 48/210; 48/DIG. 10; 122/5; 122/6 A; 422/117

[58] Field of Search ..... 48/197 R, 210, 67, 77, 48/87, 203, DIG. 10; 165/70, 134.1; 122/5, 7 R, 6 A, 506; 422/117

[56] References Cited

U.S. PATENT DOCUMENTS

| | | | |
|---|---|---|---|
| 2,627,455 | 2/1953 | Berg | 48/203 |
| 3,446,188 | 5/1969 | Nozawa et al. | 165/70 |
| 4,166,499 | 9/1979 | Sundqvist | 48/67 X |
| 4,233,137 | 11/1980 | Ozaki et al. | 48/210 X |

*Primary Examiner*—Barry S. Richman
*Assistant Examiner*—Joye L. Woodard
*Attorney, Agent, or Firm*—Michael J. Striker

[57] ABSTRACT

In a method for safely operating a coal gasifier which is indirectly cooled by passing a heat-carrying oil through a cooling jacket of the gasifier, the pressure of the heat-carrying oil is continually measured after having passed through the cooling jacket. If the measured pressure falls below a predetermined pressure, the supply of coal and gasifying agents to the gasifier is interrupted, the passage of heat-carrying oil is interrupted and water or steam is passed through the cooling jacket until the gasifier is safely shutdown.

2 Claims, 1 Drawing Figure

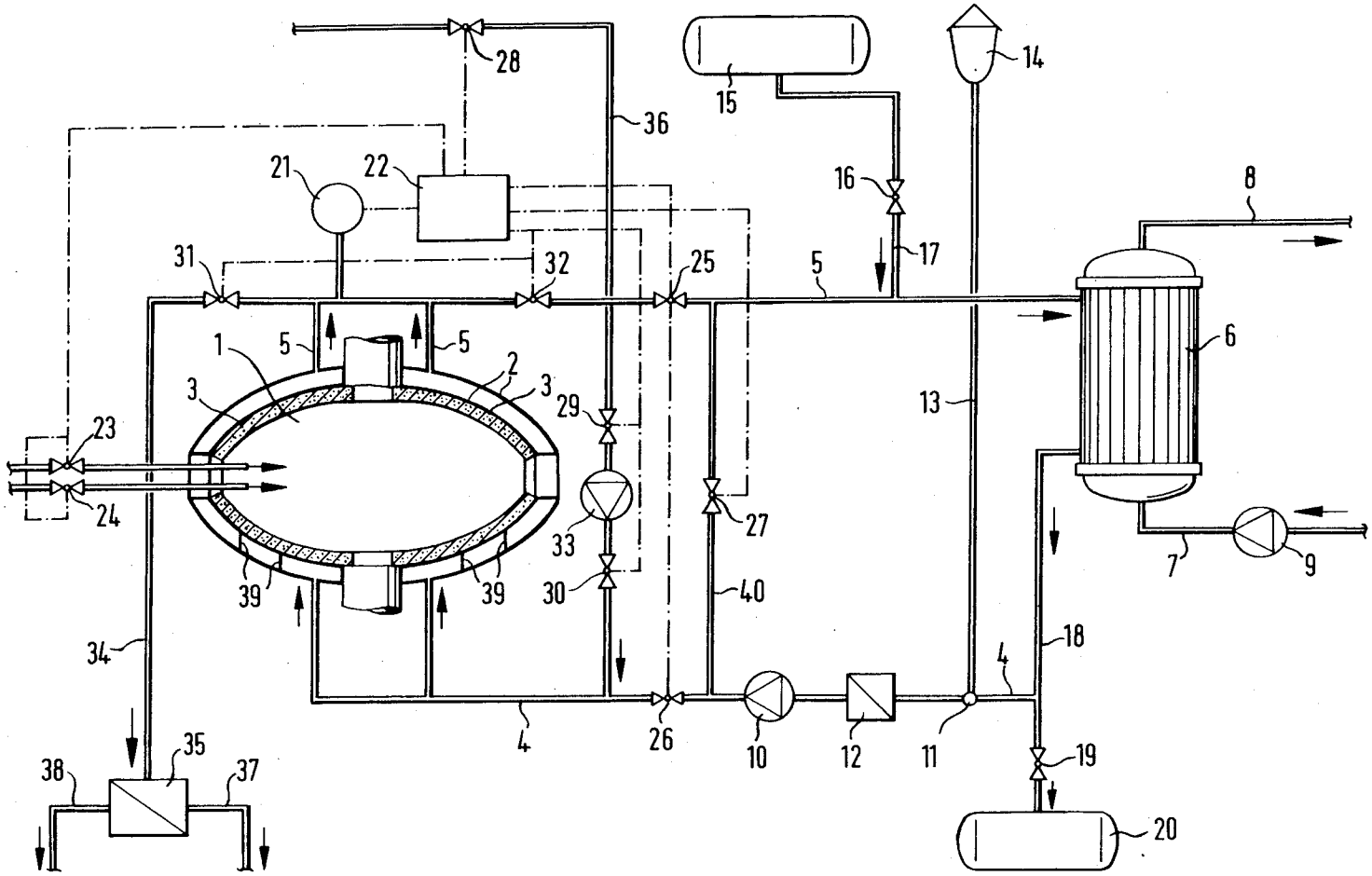
8
6
9
7
20
19
18
14
4
13
11
17
16
12
5
15
10
27
40
25
26
36
29
33
30
32
3
2
28
39
5
22
21
5
1
39
3
31
37
35
34
23
24
38

METHOD FOR OPERATING A COAL GASIFIER

BACKGROUND OF THE INVENTION

The present invention pertains to a method and a device for producing medium pressure vapor of pressure from 30 to 80 bar during the cooling of a coal gasifier operated at temperatures from 1200° to 1600° C. and under pressure from 1 to 3 bar.

Methods of gasifying coal,in which temperatures and pressures of the aforementioned ranges are involved, have been known. A specifically known and widely utilized is the method which is known as Koppers-Totzek method, in which fine-grained-up to dust coal is converted into a flowing stream with respective remaining reaction components. Gasification temperatures in the coal gasifier are so adjusted that they are above the melting point of the coal ash, and deposited slag in the melted condition can be removed from the gasifier. The gasification temperature must be higher or lower in accordance with a temperature range in which various coal types melt and in accordance with the reactivity of the coal. With unreactive or inert coals, gasification temperatures used are as high as possible with reference to durability of a fire resistant lining of the gasifier. If the cooling of the reaction space of the coal gasifier becomes more intensive the higher gasification temperatures can be obtained, however, maximal permissible temperatures of fire-resistant materials of the walls in tne reaction space would not be exceeded.

It has been known that the gasifier or its reaction space has been provided with a double jacket made of sheet steel, and in which the inner jacket has enclosed a suitable reaction space, and the jacket has been equipped with a fire-resistant lining. The intermediate space between the inner jacket and the outer jacket of the coal gasifier has been utilized as a cooling space and also for producing a low pressure or saturated vapor of 3 to 5 bar. During operation within the above mentioned pressure range it has not been necessary that the gasifier or its reaction space be formed as a pressure vessel. For coals with satisfactory reaction capabilities, technically simple and inexpensive methods for coal gasification are available in practice. In order to avoid expensive pressure vessels, vapor pressure of the gasifier cooling systems has been limited to approximately from 3 to 5 bar.

The disadvantage of the above described conventional process resides in that low pressure vapor can not be efficiently processed further. In known coal gasification installations, the ratio of the production of high pressure vapor, which is generated in a waste heat recovering vessel connected to the gasifier, to low pressure or saturated vapor, produced in the cooling jacket of the gasifier, is about 1:1. Depending on the size of the reactor, the Koppers-Totzek gasifier can be adjusted so as to supply, for example, from 5 to 20 t/h of high pressure and low pressure vapor. Thus, up to now a low pressure vapor produced in the Koppers-Totzek gasifiers has burdened the entire efficiency of the installations when no reasonable applications have been offered for low pressure vapor.

It has been proposed to solve this problem by forming the Koppers-Totzek-gasifier as a tubular vessel to enable the production of vapor of higher pressures during the cooling of the gasifier. The disadvantage of such a solution is that it requires considerable investment costs which are approximately five times higher than those for a simple double jacket-gasifier.

SUMMARY OF THE INVENTION

It is an object of the present invention to provide an improved method and a device for the production of medium pressure vapor during the cooling of a coal gasifier.

It is another object of the invention to provide a method for generating medium pressure vapor having pressure from 30 to 80 bar while simultaneously using a simple and inexpensive coal gasifier or vaporizer.

It is still another object of the invention to avoid the utilization of a pressure vessel in the vapor producing process.

These and other objects of the invention are attained by a method for producing medium pressure vapor having pressure from 30 to 80 bar during a cooling of a coal gasifier operating at temperatures from 1200° to 1600° C. and under pressures from 1 to 3 bar, comprising the steps of using heat-carrying oil in a cooling system for cooling of the coal gasifier by passing heat-carrying oil through a cooling jacket of the gasifier; providing a heat exchanger externally of the coal gasifier and connecting the heat exchanger with the coal gasifier; conveying the heat-carrying oil having the temperature from 300° to 350° C. from the gasifier to the heat exchanger wherein the heat-carrying oil is cooled down to from 240° to 270° C. and a medium pressure vapor is produced, and then recycling the heat-carrying oil from the heat exchanger into the cooling jacket of the coal gasifier.

Due to the invention a heat-carrying oil is utilized for cooling a coal gasifier or vaporizer instead of steam used up till now. In other words, oil is here a heat carrier, and the heat of this oil is used for producing medium pressure vapor in the heat exchanger provided externally of the coal gasifier.

Operational conditions in the cooling system may be adjusted so that the temperature of 350° C. and pressure of 5 bar for the heat-carrying oil will not be exceeded while a speed of a flow of the oil in the cooling system is between 2 and 3 m/s. The temperatures of the material of the coal gasifier walls remain below 500° C. The pressure vessel in the cooling system can be omitted.

The oil flow speed within the cooling system is maintained between 2 and 3 m/s to ensure the required heat flows through the walls of the gasifier for a substantial cooling of the gasifier.

Contrary to the conventional cooling and vapor-producing systems, which operate with steam, the utilization of the heat-carrying oil, which is as known burnable, requires certain safety precautions so as to avoid explosion or fire, in case of failure of one of the components of the cooling system or leakage in the cooling jacket of the coal gasifier. Therefore, according to the invention pressure of the heat-carrying oil used in the cooling system is continually controlled and a safety system and an emergency cooling system, operated with water and/or steam are provided in the cooling system, the safety system shutting down the coal gasifier if the pressure of the heat-carrying oil falls by about 2 bar below an operational pressure whereby a heat-carrying circuit is separated from the coal gasifier and the emergency cooling system is initiated until the gasifier is safely brought to a shutdown.

The temperature range of the heat-carrying oil being used may be between 0° and 350° C., whereby normal functions of the cooling system are also ensured in the range of low temperatures, e.g. during the standstill or the start of the coal gasifier.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a flow diagram illustrating the arrangement for the generation of medium pressure vapor during the cooling of the coal vaporizer according to the invention.

DETAILED DESCRIPTION OF THE PREFERRED EMBODIMENTS

Referring now to the drawing in detail,the coal gasifier denoted by reference numeral 1 is provided with a cooling jacket 2 having at the inner side thereof a refractory lining 3. Heat-carrying oil is fed into the cooling jacket 2 of the coal gasifier via a conduit 4 and is discharged from the coal gasifier in a heated condition through a conduit 5. The coal gasifier is in connection with an externally positioned heat exchanger 6 through the above mentioned conduits 4 and 5. Tangible heat of the heat-carrying oil heated up to about 340° C. is used in indirect heat exhange for the generation of the medium pressure vapor. The required boiled feed water is pumped into the heat exchanger 6 via a conduit 7 by a pump 9 whereas the medium pressure vapor produced in the heat exchanger 6 is discharged from heat exchanger 6 via a conduit 8.

The heat-carrying oil cooled down to about 250° C. in the heat exchanger is again conveyed by a pump 10 via the conduit 4 into the cooling jacket 2 of the coal gasifier. A connection 11 and a filter 12 are arranged in conduit 4 before the pump 10. A conduit 13 is branched off the conduit 4 at the connection 11, conduit 13 connecting the conduit 4 with an expansion vessel 14. Possible losses of the heat-carrying oil in the cooling system are thereby compensated for since fresh heat-carrying oil is discharged from an oil supply container 15 after the opening of a valve 16 and fed into a conduit 17, from which it is conveyed into the conduit 5. The used heat-carrying oil can be removed from the circuit via a conduit 18 and conveyed into a container 20 after a valve 19 has been opened.

The pressure of the heat-carrying oil in the cooling system is continuously controlled by means of a pressure sensor 21 of any suitable conventional design, from which a determined value of pressure is transmitted to a control unit 22 which can be also of any conventional type. In the event of pressure fall to about 2 bar below the operational pressure the commands resulting in the following actions would be automatically released by the control unit 22: the admission of the reaction agents into the coal gasifier will be interrupted by closing valves 23 and 24, and valves 25 and 26 will be simultaneously closed whereas a valve 27 will open in the direction of a connection conduit 40 arranged between conduits 4 and 5. Thereby the heat-carrying oil circuit will be separated from the cooling jacket 2.

Upon the opening of valves 28, 29, 30 and 31 and closing of a valve 32 an emergency cooling system is formed, into which water or steam is fed via conduits 36 and 4 so that a sufficient cooling of the gasifier is ensured up to the end of the process. A pump 33 installed in the conduit 36 serves the purpose of a required circulation of water in the emergency cooling system while the mixture of water and heat-carrying oil discharged from the cooling jacket 2 passes through the open valve 31 into a conduit 34 which is a branch of the conduit 5. Conduit 34 leads to an oil separator 35. In the oil separator water is separated from the heat-carrying oil by a phase separation whereby the heat-carrying oil is discharged from the oil separator into a conduit 37 and water is removed from the oil separator via a conduit 38. The connection conduits shown by dash-dotted lines and provided between the control unit 22 and the individual valves transmit required control impulses from the control unit to the valves. The valves are provided with respective suitable conventional position drives.

The coal gasifier 1, which is shown in the drawing in a simplified manner, can have any suitable construction. However, the utilization of a so-called double jacket gasifier, in which plates or baffles 39 are provided in the interior of the cooling jacket 2, is specifically advantageous for this type of the cooling system. The hollow interior of the cooling jacket 2 is subdivided by plates or fins 39 so that flow passages are formed, in which flow speeds are automatically adjusted to 2–3 m/s.

Although the method of this invention has been discussed herein in connection with the coal gasifier it is of course understood that this method is not limited to the coal gasifier. It is also understandable that other solid and fluidic fuels can be employed as charge materials for the coal gasification.

The method of the invention offers the production of medium pressure vapor with the utilization of a coal gasifier in a very simple manner while the efficiency of the coal gasification process is significantly increased.

It will be understood that each of the elements described above, or two or more together, may also find a useful application in other types of methods and devices for generating medium pressure vapor during a cooling of a coal gasifier differing from the types described above.

While the invention has been illustrated and described as embodied in a method and a device for the generation of a medium pressure vapor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for safely operating a gasifier during coal gasification wherein coal and gasifying agents are supplied to said gasifier which operates at temperatures from 1200° to 1600° C. and under pressures from 1 to 3 bar, the method comprising the steps of using pressurized heat-carrying oil in a cooling system for cooling of the coal gasifier by passing said heat-carrying oil through a cooling jacket of the gasifier; providing a heat exchanger externally of the coal gasifier and connecting the heat exchanger with the cooling jacket of said coal gasifier; conveying the heat-carrying oil having a temperature from 300° to 350° C. from the cooling jacket of said gasifier to the heat exchanger wherein the heat-carrying oil is cooled down to from 240° to 270° C. and a medium pressure vapor is produced, recycling the heat-carrying oil from the heat exchanger into the cooling jacket of the coal gasifier; continually measuring the pressure of the heat-carrying oil after having passed through said cooling jacket and interrupting the supply of coal and gasifying agents to the gasifier and the passage of said heat-carrying oil to said cooling jacket if the measured pressure of the heat-carrying oil falls by about 2 bar below a predetermined pressure and passing water or steam to the cooling jacket until the gasifier is safely shutdown.

2. The method as defined in claim 1, wherein said predetermined pressure is 5 bars at an oil flow rate of between 2 and 3 m/s and an oil temperature of 350° C.

* * * * *